United States Patent [19]

Harris

[11] 3,998,010

[45] Dec. 21, 1976

[54] CYLINDRICAL GRINDER

[75] Inventor: James C. Harris, Waynesboro, Pa.

[73] Assignee: Landis Tool Company, Waynesboro, Pa.

[22] Filed: Dec. 24, 1975

[21] Appl. No.: 644,121

[52] U.S. Cl. ..... 51/105 SP; 51/165.77; 51/165.91

[51] Int. Cl.[2] ..... B24B 5/04; B24B 51/00

[58] Field of Search ..... 51/105 R, 105 SP, 165 R, 51/165.77, 165.8, 165.89, 165.9, 165.91, 238 S

[56] References Cited

UNITED STATES PATENTS

| | | | |
|---|---|---|---|
| 3,271,910 | 9/1966 | Haisch | 51/105 SP |
| 3,487,588 | 1/1970 | Temple | 51/165.77 |
| 3,690,071 | 9/1972 | Hill | 51/105 SP X |
| 3,690,072 | 9/1972 | Price | 51/165.91 X |
| 3,904,390 | 9/1975 | Bottomley | 51/105 R X |

*Primary Examiner*—Al Lawrence Smith
*Assistant Examiner*—Nicholas P. Godici
*Attorney, Agent, or Firm*—Spencer T. Smith

[57] ABSTRACT

A cylindrical grinder for simultaneously effecting stock removal from a plurality of work diameters of a rotating driven workpiece comprising a grinding wheel assembly including a plurality of grinding wheels, means for advancing the grinding wheels toward the workpiece from a predetermined first position to a predetermined second position at a selected feed rate, a workrest assembly operatively associated with a central work diameter including upper and lower workrest jaws, and means for incrementally displacing said upper workrest jaw towards the central diameter, means for sensing the magnitude of the non-linearity of the workpiece, and means for conjointly deenergizing the incrementally displacing means when the magnitude of the non-linearity sensed by the sensing means exceeds a predetermined maximum value.

3 Claims, 7 Drawing Figures

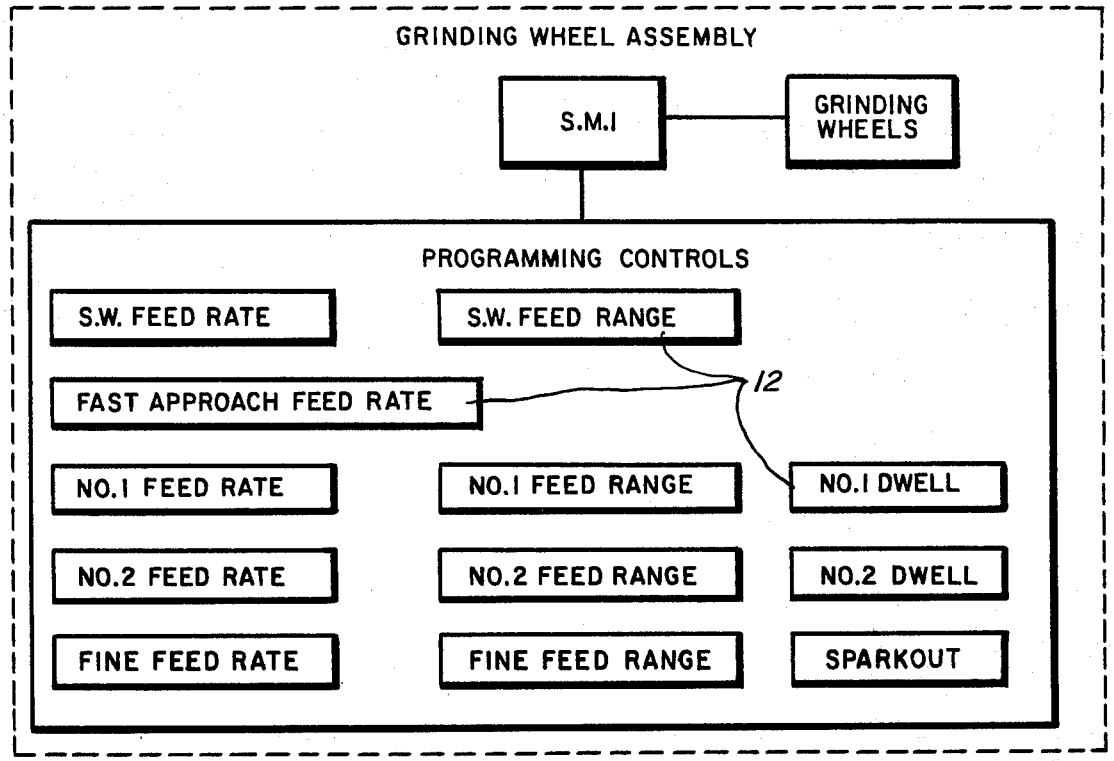
Fig_2
Fig_4a
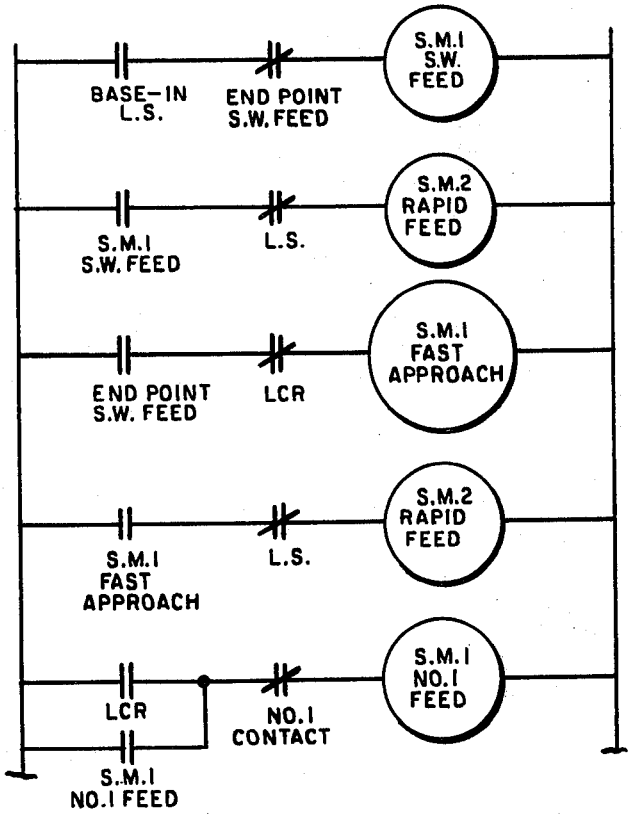

CYLINDRICAL GRINDER

The present invention relates to cylindrical grinding machines and particularly to multiwheel cylindrical grinders which simultaneously effect stock removal from a plurality of work diameters.

In a multiwheel grinding machine a workpiece is supported between a pair of rotatable chuck jaws or work centers, and a grinding wheel assembly, which includes a plurality of rotating grinding wheels is advanced toward the workpiece to simultaneously effect stock removal from a plurality of work diameters. The grinding wheel assembly tends to bow the workpiece out of a linear configuration during grinding and any resulting deflection or non-linearity gives rise to errors in the finished workpiece. Such deflection also results in the uneven wearing of the grinding wheels which necessitates frequent dressing.

A plurality of spaced workrests are conventionally continuously operated during a portion of the grinding cycle to uniformly oppose the deflecting forces of the advancing grinding wheel assembly. Gages associated with a center and an end work diameter are utilized to visually identify a bowed out condition of the workpiece and the machine operator manually further advances the already operational center workrest during this portion of the grinding cycle to linearize the workpiece. This procedure produces uncertain, nonuniform results and tends to deleteriously effect the desired surface quality of the ground work diameters.

It is accordingly an object of the present invention to provide a cylindrical grinder, wherein the linearity of the workpiece will be precisely controlled in a manner which will result in a minimal deviation from the desired stock removal program.

Other objects and advantages of the present invention will become apparent from the following portion of this specification and the accompanying drawings which illustrate in accordance with the mandate of the patent statutes a presently preferred embodiment incorporating the principles of the invention.

Referring to the drawings:

FIG. 2 is a diagrammatic representation of a portion of the grinding wheel assembly.

Figure 1:
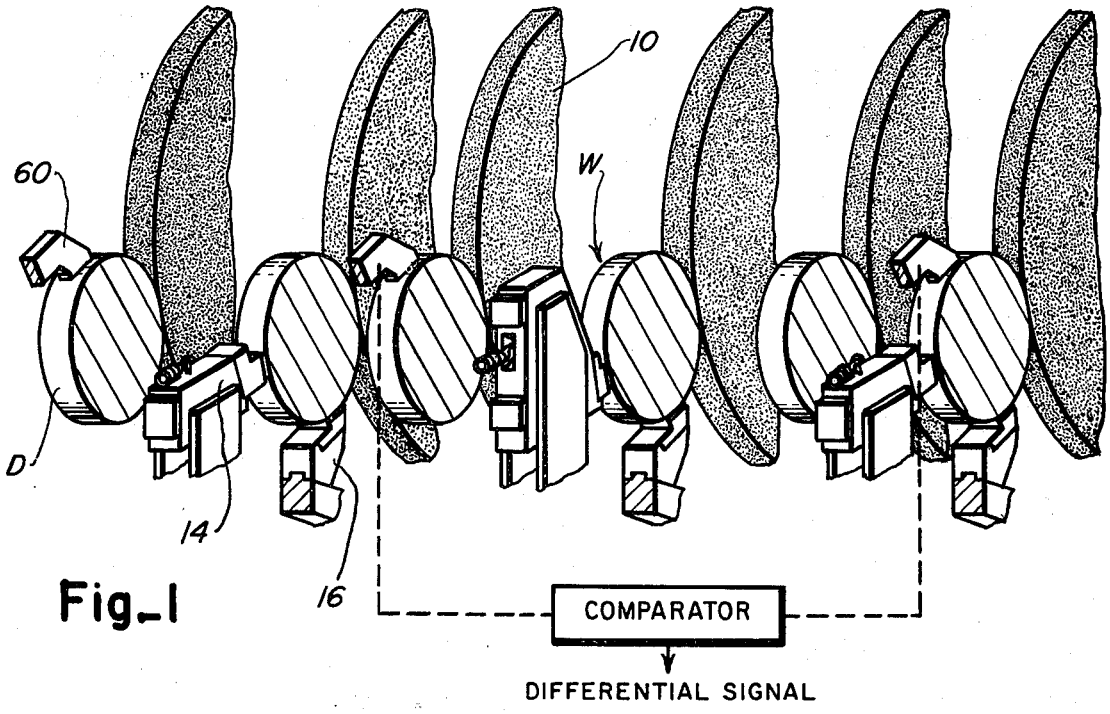
FIG. 1 is an oblique view of a portion of a multiwheel cylindrical grinding machine.
Figure 5:
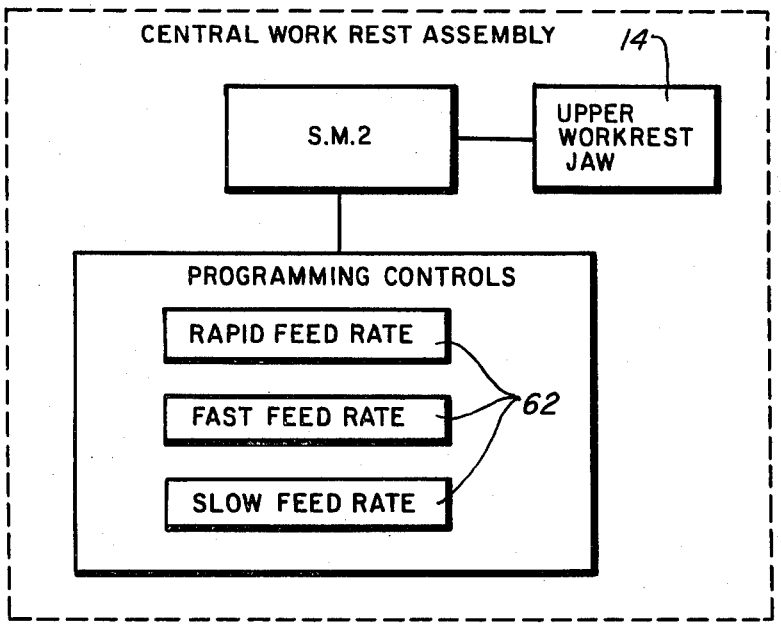
Figure 4C:
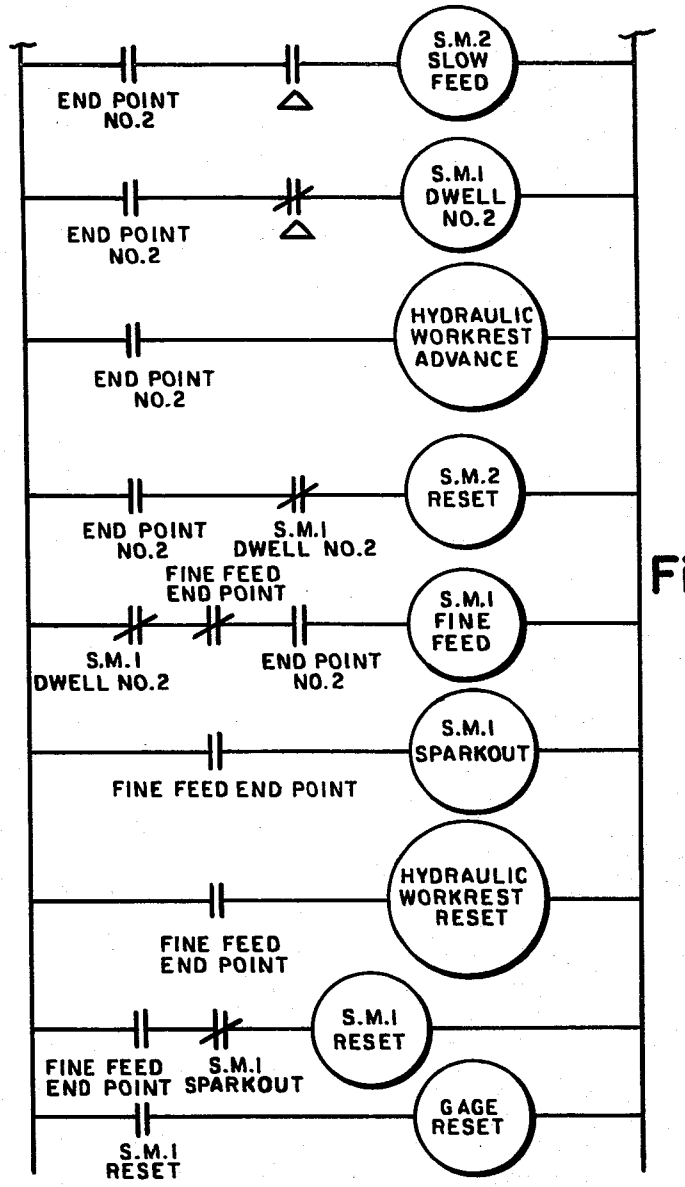
Figure 4B:
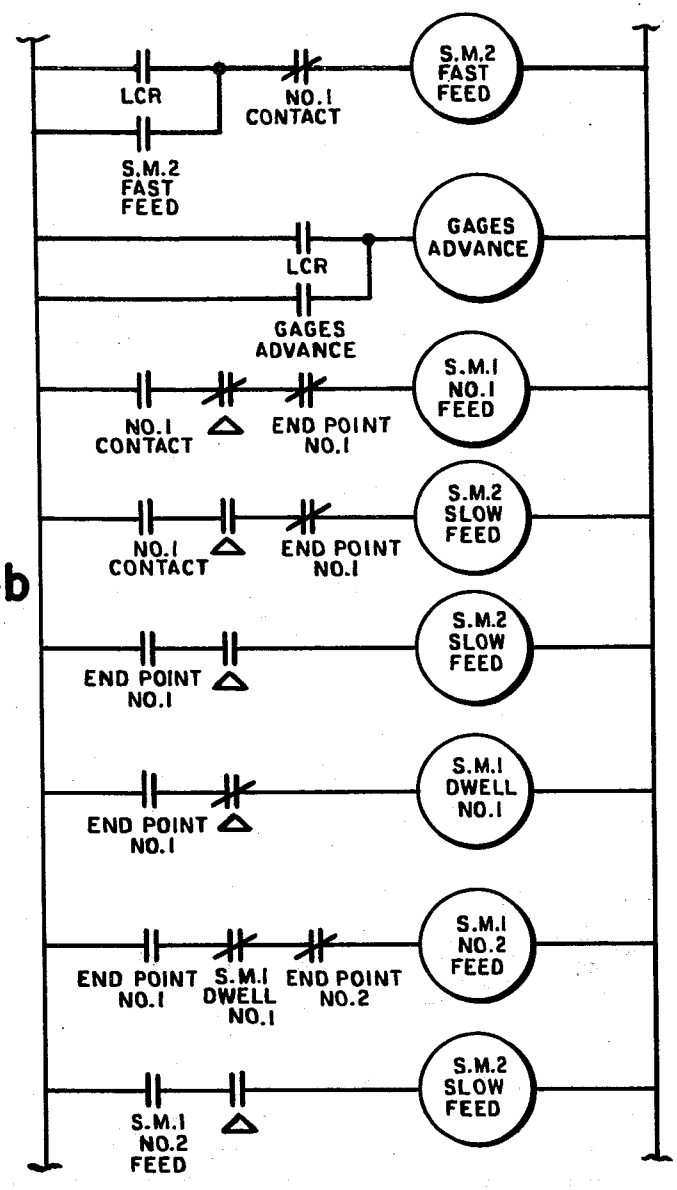

FIGS. 4*a–c* are a control circuit for operating the cylindrical grinding machine; and FIG. 5 is a diagrammatic representation of a portion of the central workrest assembly.

The cylindrical grinding machine includes a grinding wheel assembly having a plurality of grinding wheels 10 which simultaneously effect stock removal from a corresponding plurality of work diameters D of a rotatively supported workpiece W.

The grinding wheels are conventionally hydraulically advanced from a fully retracted position to a forward position and electrically advanced, by the selective operation of a motor such as a stepping motor S.M.1 (FIG. 2) from the forward position to a final position in a sequence of grinding movements involving selected feed rates over selected feed ranges followed by selected dwell periods. These feed rates, feed ranges and dwell periods are defined by selectively variable thumbwheel switches 12. One sequence is as follows: SIDEWALL FEED, FAST APPROACH, No. 1 FEED, No. 1 DWELL, BACKOFF, No. 2 DWELL, No. 2 FEED, No. 3 DWELL, FINE FEED, SPARKOUT. The details of such an electronic feed system are disclosed in detail in U.S. Pat. No. 3,716,949.

To minimize the degree of workpiece non-linearity arising from the advancement of the grinding wheels, upper 14 and lower 16 workrest jaws of the central and end workrests are hydraulically displaced into forcefull engagement with associated work diameters by means of associated upper and lower hydraulic cylinder assemblies 18, 20. The upper hydraulic cylinder assembly includes a hydraulic cylinder 22 which displaces a button element 24 to control the position of the upper workrest jaw and the lower hydraulic cylinder assembly includes a hydraulic cylinder 26 which displaces a camming element 28 to control the displacement of the lower workrest jaw. Conventionally, these hydraulic cylinder assemblies are advanced into work diameter engaging position during the No. 1 dwell period and are retracted at the conclusion of sparkout. The hydraulic cylinder assemblies which advance the upper and lower workrest jaws are conventional in character and are dislosed in detail in U.S. Pat. No. 3,691,701.

Figure 3:
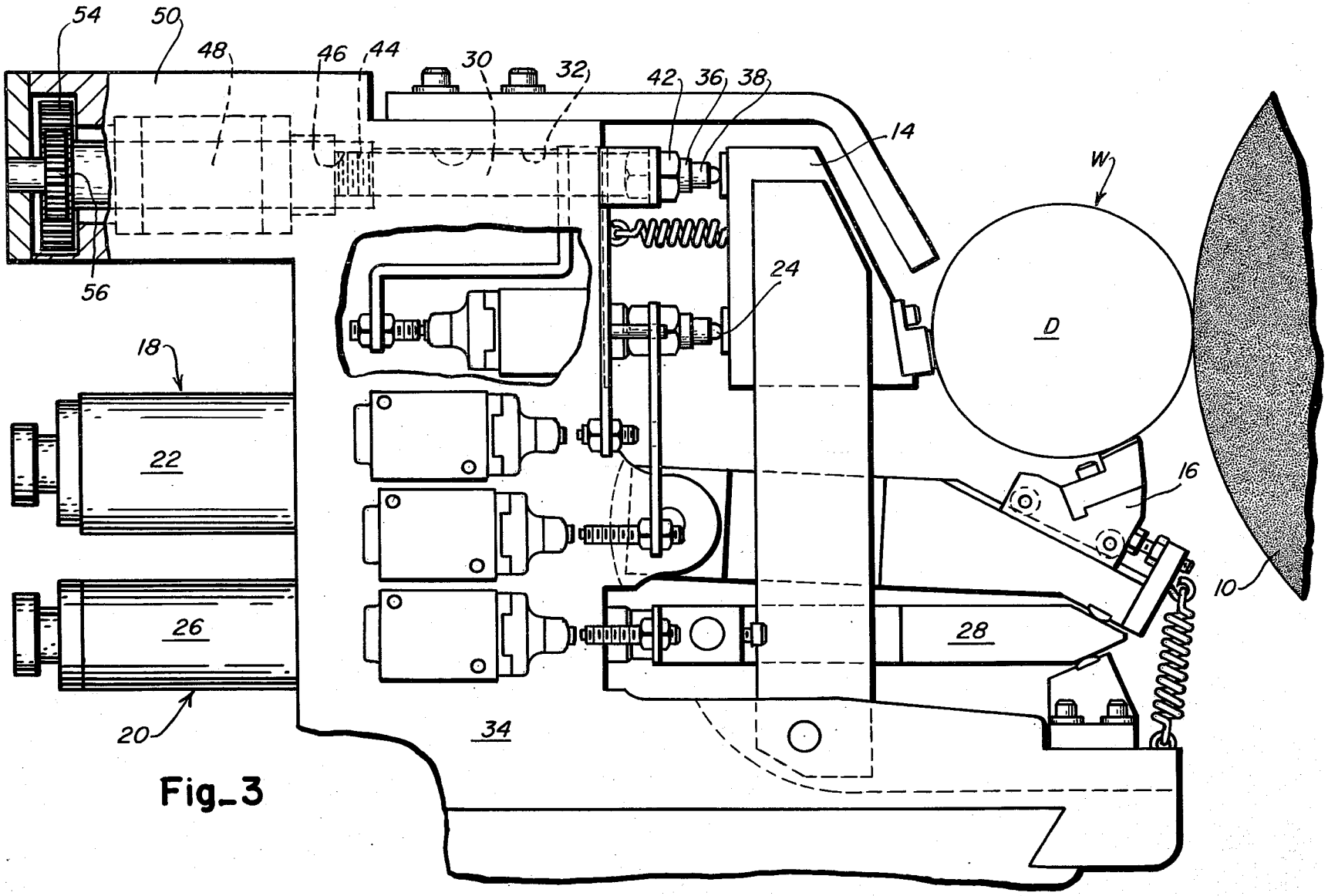
FIG. 3 is an elevational detail view of the central workrest assembly of the cylindrical grinding machine illustrated in FIG. 1.

In the preferred embodiment, the upper workrest jaw of the central workrest assembly which is illustrated in FIG. 3, can be advanced either by the upper hydraulic cylinder assembly 18 or by a motor assembly including a motor such as a stepping motor S.M.2, which selectively positively advances the upper jaw 14 towards the central work diameter. The motor assembly additionally includes a plunger 30 which is slidably mounted within a bore 32 of the workrest base 34. An adjusting screw 36, having a hardened button 38, is secured within a threaded bore of the plunger 30 and is locked in axial position by a nut 42. The left-hand end of the plunger 30 includes a threaded shank 44, which is received by a threaded bore 46 of a spindle 48. The spindle 48 is rotatably journaled in a gear housing 50 which is secured to the workrest base 34. A gear 54 secured to the spindle 48 is connected to the drive gear of the workrest stepping motor S.M.2 through an idler gear 56. The idler gear 56 is rotatably journaled in the gear housing 50 to transfer rotary movement from the drive gear of the stepping motor S.M.2 to the driven gear 54.

Size gages 60 are associated with the end work diameters and a central work diameter. The size sensed by one end gage is continuously compared by a comparator with the size sensed by the central gage and when this difference exceeds a maximum allowable value, a differential signal will be generated.

The advancement of the grinding wheel assembly from the fully retracted position to the forward position will transfer the base-in limit switch (FIG. 4*a*). The grinding wheel assembly stepping motor S.M.I will then be driven at a selected sidewall (S.W.) feed rate until the grinding wheels are advanced to a predetermined sidewall feed end point. The grinding wheel assembly stepping motor S.M.1 will then be driven at a fast approach rate until the grinding wheels impact against the work diameters whereupon a load control relay LCR will be actuated. The central workrest stepping motor S.M.2 will operate at the commencement of sidewall feed and will advance the upper jaw of the central workrest at a selected rapid feed rate until it has been advanced to a ready position where a limit switch L.S. will be closed. The rapid feed rate of the workrest stepping motor as well as the fast and slow feed rates (FIG. 5) may be varied as desired by changing the setting of associated thumbwheel switches 62. The rapid feed rate is selectively chosen so that the upper jaw will arrive at the ready position prior to the actuation of the load control relay LCR.

When the load control relay LCR is actuated, the three workrest gages will be advanced into following engagement with associated work diameters. Additionally, the grinding wheel assembly stepping motor S.M.1 will be continuously driven at a No. 1 feed rate, which will cause the workpiece to immediately bow out of its neutral, linear configuration, and the workrest stepping motor S.M.2 will conjointly be continuously driven at a fast feed rate to continuously advance the upper workrest jaw to reduce the degree of this nonlinearity. The fast feed rate can be adjusted by changing the associated thumbwheel switch so that the non-linearity will be reduced but an opposite non-linearity will not be created.

At the No. 1 gage contact, which closes at a point intermediate the end points of the No. 1 feed range, the workrest stepping motor S.M.2 will continue to advance the upper workrest jaw at the fast feed rate until the differential signal disappears.

When this differential signal is removed, the grinding wheel assembly stepping motor S.M.1 will again advance the grinding wheels at the No. 1 feed rate until the No. 1 feed end point is reached. Whenever a differential signal is generated, as the grinding wheels are advanced from the NO. 1 contact to the No. 1 feed end point, the No. 1 feed of the grinding assembly stepping motor S.M.1 will be interrupted and the workrest stepping motor S.M.2 will be advanced at a slow feed rate until the differential signal disappears. If the differential signal is present when the No. 1 end point is reached, the workrest stepping motor S.M.2 will operate until the differential signal is removed. The No. 1 dwell will then take place.

At the end of the No. 1 dwell, the grinding wheel stepping motor S.M.1 will be continuously advanced at a substantially slower No. 2 feed rate to a No. 2 feed end point and the workrest stepping motor S.M.2 will be advanced at the slow feed rate whenever the differential signal appears. When the No. 2 end point is reached (No. 2 gage contact closes), the workrest stepping motor S.M.2 will continue to operate until the differential signal if any is present, is removed. The No. 2 dwell will then take place.

The hydraulic cylinder assemblies associated with the upper and lower workrest jaws are actuated at the beginning of the No. 2 dwell and advance to a fixed end point. The workrest stepping motor S.M.2 is reset at the conclusion of the No. 2 dwell.

Feed of the grinding wheel assembly stepping motor S.M.1 recommences at the end of the No. 2 dwell at a fine feed rate and continuously advances the grinding wheels until the fine feed end point (gage contact No. 3 closes), is reached, whereupon the hydraulic cylinders are reset and sparkout occurs.

At the conclusion of sparkout, the gages are retracted and the grinding wheel stepping motor S.M.1 is reset to re-establish the electronic feed system at an initial condition.

What is claimed is:

1. A cylindrical grinder for simultaneously effecting stock removal from a plurality of work diameters of a rotating driven workpiece comprising a grinding wheel assembly including a plurality of grinding wheels, means for advancing said grinding wheels toward the workpiece from a predetermined first position to a predetermined second position at a selected feed rate, a workrest assembly operatively associated with a central work diameter including upper and lower workrest jaws, means for incrementally displacing said upper workrest jaw towards the central diameter, means for sensing the magnitude of the non-linearity of the workpiece, and means for conjointly deenergizing said advancing means and energizing said incrementally displacing means during the advancement of said grinding wheels from said first position to said second position when the magnitude of the non-linearity sensed by said sensing means exceeds a predetermined maximum value.

2. A cylindrical grinder according to claim 1, further comprising means for continuously advancing said grinding wheels from said predetermined second position to a predetermined third position and means for energizing said incrementally displacing means during the advancement of said grinding wheels from said second position to said third position when the magnitude of the non-linearity sensed by said sensing means exceeds a predetermined value.

3. A cylindrical grinding machine according to claim 2, further comprising means for continuously advancing said grinding wheels toward the workpiece from an initial position to said first position and means for conjointly energizing said incrementally advancing means as said grinding wheels are advanced from said initial position to said first position.

* * * * *